US007458331B2

(12) United States Patent
Zsido

(10) Patent No.: US 7,458,331 B2
(45) Date of Patent: Dec. 2, 2008

(54) TABLE MOUNT FOR BOAT

(75) Inventor: Joseph Zsido, Benton, IL (US)

(73) Assignee: Custom Stainless Steel, Inc., Benton, IL (US)

( * ) Notice: Subject to any disclaimer, the term of this patent is extended or adjusted under 35 U.S.C. 154(b) by 0 days.

(21) Appl. No.: 11/581,821

(22) Filed: Oct. 17, 2006

(65) Prior Publication Data

US 2008/0087210 A1 Apr. 17, 2008

(51) Int. Cl.
*B63B 29/04* (2006.01)

(52) U.S. Cl. ..... 114/195

(58) Field of Classification Search ..... 114/195, 114/188, 364; 248/225.11; 297/170
See application file for complete search history.

(56) References Cited

U.S. PATENT DOCUMENTS 493,605 A * 3/1893 Tiffany ..... 108/10
2,604,930 A * 7/1952 Dean et al. ..... 297/170
4,929,116 A * 5/1990 Mahl ..... 403/263
5,026,016 A * 6/1991 Lisowski ..... 248/314
6,554,354 B1 * 4/2003 Hoffman et al. ..... 297/145

* cited by examiner

*Primary Examiner*—Stephen Avila
(74) *Attorney, Agent, or Firm*—Wood, Phillips, Katz, Clark & Mortimer

(57) ABSTRACT

A device support for the passenger area of a recreational boat having a deck and interior side walls extending up from the deck, including a clamping plate and a support arm. The clamping plate has an open top slot and is secured to the boat side wall so as to define an open top space between the clamping plate and the boat side wall. The support arm has a base plate on one end and an attachment end on the other end, with the base plate removably received in the defined open top space with the support arm one end extending through the open top slot of the clamping plate. The supported device is secured to the attachment end of the support arm, and the support arm is non-linear, with one end extending generally horizontally and the other end extending generally vertically.

6 Claims, 3 Drawing Sheets

TABLE MOUNT FOR BOAT

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates to recreational boats, and more particularly to a support for boat amenities.

BACKGROUND OF THE INVENTION AND TECHNICAL PROBLEMS POSED BY THE PRIOR ART

Recreational boats are happily used by people on various bodies of water for a wide variety of activities including, for example, fishing water skiing and wake boarding, as well as racing over the water and more mundane peaceful, leisurely travel. Moreover, many people enjoy doing nothing other than enjoying a day while simply sitting on a boat in the peaceful serenity found on a body of water away from the noise and hustle of life on shore.

With so many such enjoyable activities, in fact, many boat users will spend large amounts of their leisure time out on the water on a boat. As a result, during such leisure time the boat will become the home of the users for long periods of time, albeit with somewhat cramped space and facing the keeping water out of the boat user space. As a result, boat manufacturers have found it to be not only desirable for their customers, but necessary to maintain boat sales, to provide amenities in the boat user space which allows for full enjoyment of boating activities. Such amenities, however, are constrained by space limitations and related cost limitations (e.g., while a boat may be made larger to provide more space for one or more amenities, the increase cost of such a larger boat may take the boat out of the price range of many potential purchasers), and are further constrained by the environmental factors unique to a boat floating in the middle of a body of water.

As a result of space limitations, removable amenities have frequently been provided. For example, tables providing space to conveniently eat food or set other items such as drinks have been mounted to boat decks so as to be removable and stored out of the way to open that deck space when the table is not needed. While such tables have provided the desired convenience to place food or drinks, for example, their removable pedestal bases secured to the boat deck require cutting into the boat deck in order to secure the required pedestal mount in the deck. Beyond the obvious problem of unnecessary deck holes in a water environment, such mounts can present safety issues when the base is not mounted thereto. That is, the irregular surface of the deck resulting from the pedestal mounts in the deck could cause a person on the boat to trip and/or (particularly inasmuch as many boat users are barefoot) hurt their foot if they step on the mount incorrectly.

The present invention is directed toward overcoming one or more of the problems set forth above.

SUMMARY OF THE INVENTION

According to the present invention, a device support for the passenger area of a recreational boat having a deck and interior side walls extending up from the deck is provided. The support includes a clamping plate and a support arm. The clamping plate has an open top slot and is secured to the boat side wall so as to define an open top space between the clamping plate and the boat side wall. The support arm has a base plate on one end and an attachment end on the other end, with the base plate removably received in the defined open top space with the support arm one end extending through the open top slot of the clamping plate. The supported device is secured to the attachment end of the support arm, and the support arm is non-linear, with one end extending generally horizontally and the other end extending generally vertically.

In one form of the invention, the slot is substantially U-shaped.

In another form of the invention, the open top space has a width tapering outwardly toward its open top. In a further form, the base plate is tapered with a shape substantially matching the open top space.

In still another form of the invention, the device is a table top extending substantially at a right angle relative to the support arm other end.

In yet another form of the invention, the support arm is a curved tube.

In a still further form of the invention, the attachment end includes a pedestal base secured to the support arm and the pedestal base is secured to the device. In a further form, the device is a table top.

In another form of the invention, the clamping plate extends radially outwardly around the support arm at the support arm one end.

In still another form of the invention, a backing plate is secured between the clamping plate and the boat side wall, wherein the open top space is between the clamping plate and the backing plate. In one further form, mounting screws extend through the clamping plate, backing plate and boat interior side wall. In another further form, mounting bolts extend through the clamping plate, backing plate and boat interior side wall, and nuts are secured to the bolts on the back side of the boat interior side wall. In still another further form, the clamping plate is metal and the backing plate is plastic.

DETAILED DESCRIPTION OF THE INVENTION

Figure 1:
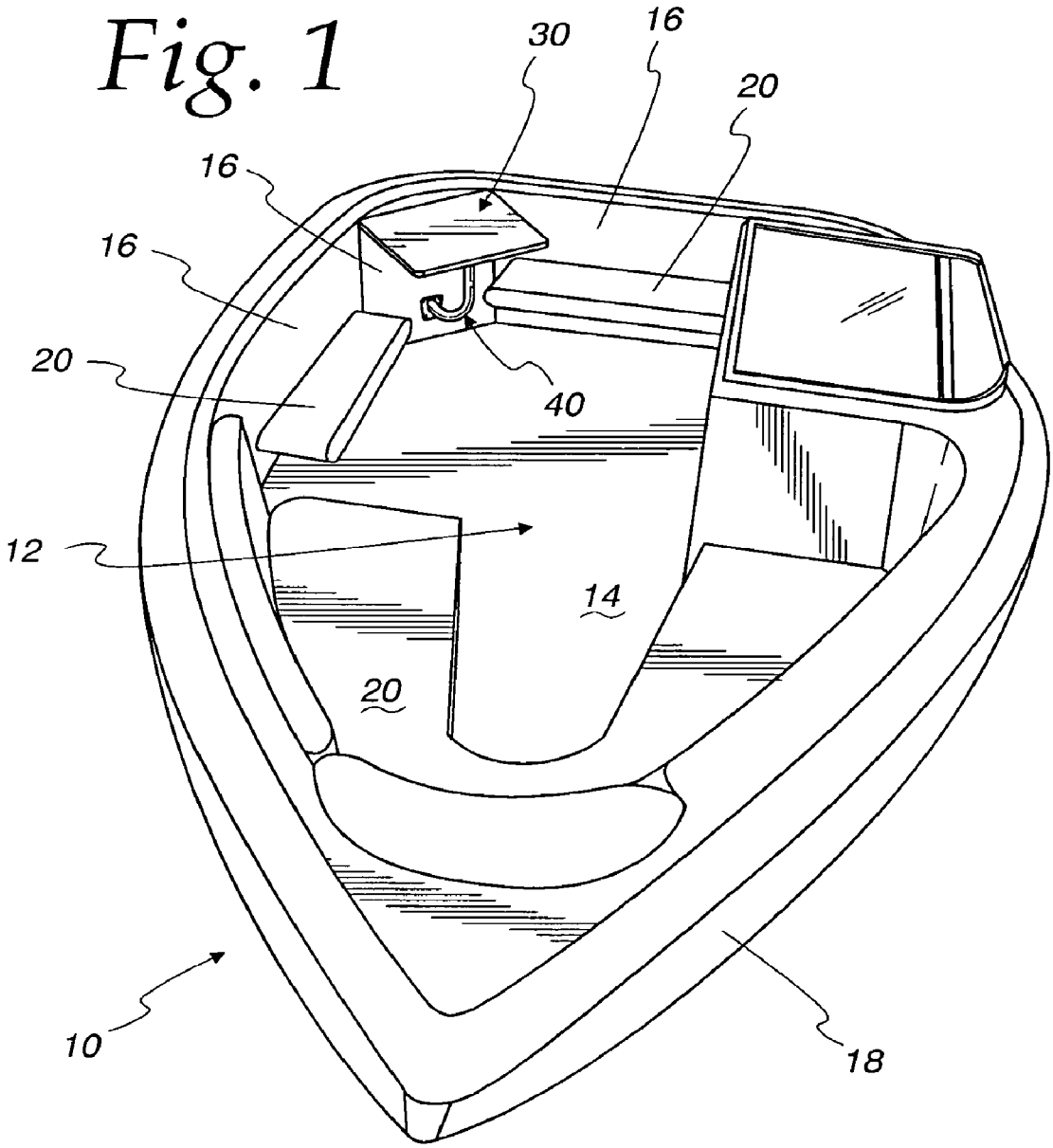
FIG. 1 is a perspective view of a boat having a table mounted according to the present invention.

FIG. 1 is a simplified illustration of a boat 10 having a passenger space or area 12 with a deck 14 and side walls 16 inside an outer hull 18. Various amenities, such as benches 20 for passenger sitting, may be provided therein. Though not shown in the Figures, such recreation or leisure boats 10 may, and commonly will, have other features such as inboard and/or outboard motors, controls, and various instruments.

A removable table 30 is mounted to a side wall 16 according to the present invention. It should thus be appreciated that the table 30 may be used to allow passengers around it to place items on the table 30. For example, persons sitting on the adjacent benches 20 may conveniently place their drinks on the table 30 and reach them when they want another sip as they enjoy a leisurely time on the boat 10.

It should be appreciated, however, that the location of the table 30 on the illustrated boat 10 is merely an example, and that in other configuration boats the table 30 may be mounted at a selected one of a plurality of provided positions along a side of the boat 10, near the aft or stern, and on the port or starboard sides. Suitable positions for one or more tables 30 according to the present invention can be determined based on the configuration of the passenger area 12 of the boat 10.

Moreover, it should be appreciated that the support or mount 40 of the present invention may be used to removably secure many different devices which may be desired, from time to time in the passenger area 12, including, for example, a video display monitor, a gas grill, and still other devices which may add to the enjoyment of the passengers on the boat 10.

As best illustrated in FIGS. 2-5, the mount 40 includes a support arm 44 having a base plate 46 on one end and a suitable device attachment 48 on the other (upper) end. The mount 40 also includes a clamping plate 50 and a backing plate 52 which are suitably secured to the boat side wall 16, for example by suitable screws or nuts and bolts (with the bolts on the back face of the side wall 16) 56 extending through the plates 50, 52 and the interior boat side wall 16.

The clamping plate 50 includes an open top, generally U-shaped slot 60 having a width or horizontal dimension which, in its most firm mounting configuration, is essentially only slightly greater than the diameter of the support arm 44 at the base plate end. Further, the back side of the clamping plate 50 is recessed around the slot 60 (e.g., includes a raised portion 62 around the outer edge of the clamping plate 50) to define an open top space between the clamping plate 50 and the backing plate 52.

By sizing the raised portion 62 defining the sides of the open top space to match the flat sides of the base plate 46 (e.g., shaping the base plate 46 to substantially match the open top space between the clamping and backing plates 50, 52), it should be appreciated that the support arm 44 will be suitably secured against rotating. However, it should also be appreciated that other structures including, for example, flat sides on the bottom end of the support arm 44 received between matching flat sides of the open top slot 60, could also be used to ensure that the support arm 44 will not rotate when mounted.

Figure 2:
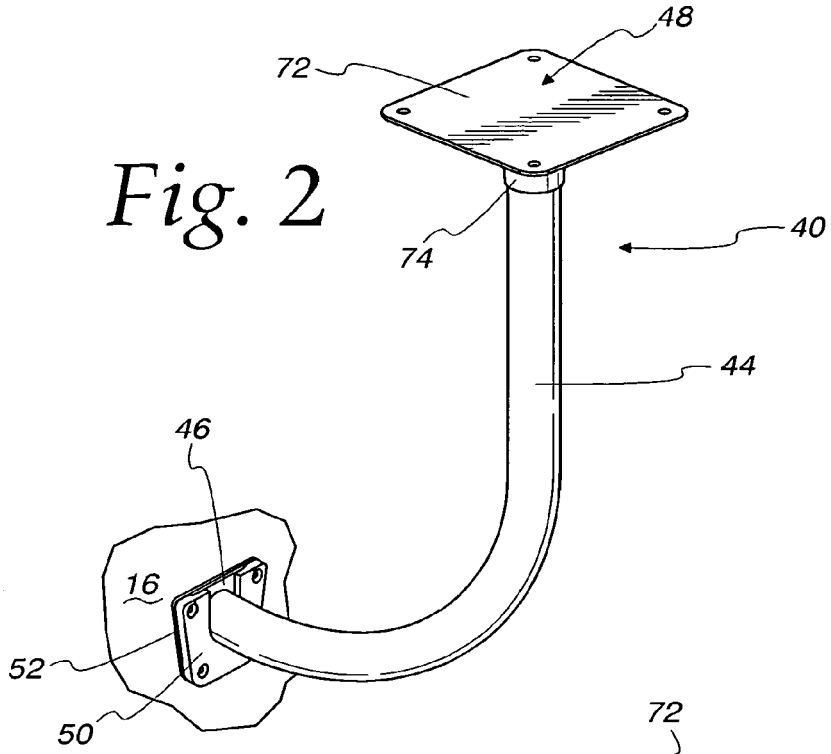
FIG. 2 is a perspective view of a table mount according to the present invention, as mounted to a boat.
Figure 3:
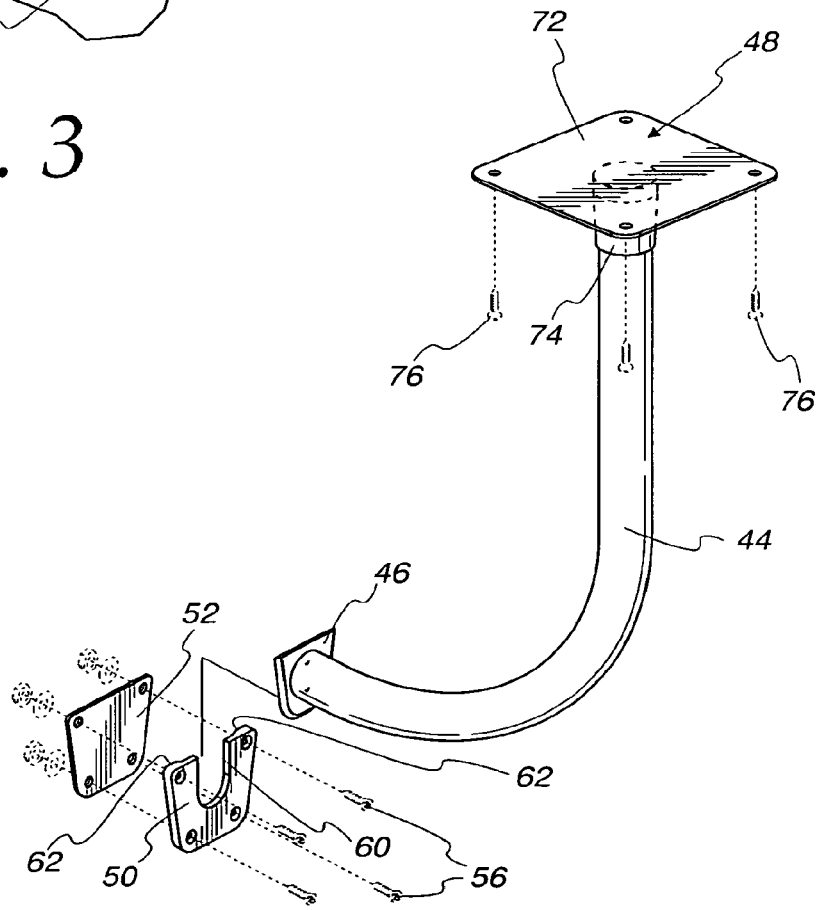
FIG. 3 is an exploded perspective view of the FIG. 2 table mount.

The device attachment 48 may be fixed or removably secured to the upper end of the support arm 44, and may be configured so as to suitably attach to the desired device. For example, as illustrated in FIGS. 2-3, the attachment 48 may be a pedestal base provided to secure a table top 70 (see FIGS. 4-5), with the attachment 48 including a mounting plate 72 secured to a socket 74 on its bottom side, which socket 74 may be fixed to, or removably receive, the upper end of the support arm 44. Suitable connectors such as screws 76 (see FIG. 3) may be provided to extend through the mounting plate 72 to secure the table top 70 thereon.

As illustrated, the support arm 44 is a curved or bent tube having its lower end generally horizontal and a generally vertical upper end. However, it should be appreciated that still different support arm configurations could be used within the broad scope of the present invention, depending upon the size of the supported device and its desired orientation of the supported device, as well as other factors such as the slope, if any, of the boat side wall 16 relative to vertical. Generally, however, the support arm 44 should be sized and configured so as to cause the particular supported device, such as the table top 70, to be supported vertically above the deck 14 and laterally away from the boat side wall 16 in a convenient desirable position, while also allowing the arm base plate 46 to be conveniently received and supported in the open top space between the plates 50, 52 with the adjacent end of the support arm resting securely in the slot 60 of the clamping plate 50.

It should thus be appreciated that a single support arm 44 may be interchangeably used to mount different devices, in which case different attachments 48 may be used for different devices (or universal mounting attachments may be used). Alternatively, different support arms may be used for different devices (for example, a table top 70 may use one support arm configured to support a device at a significant distance from the side wall 16, whereas a grill (which would not be intended to extend into the passenger area 12 very far) could use a different support arm.

Figure 4:
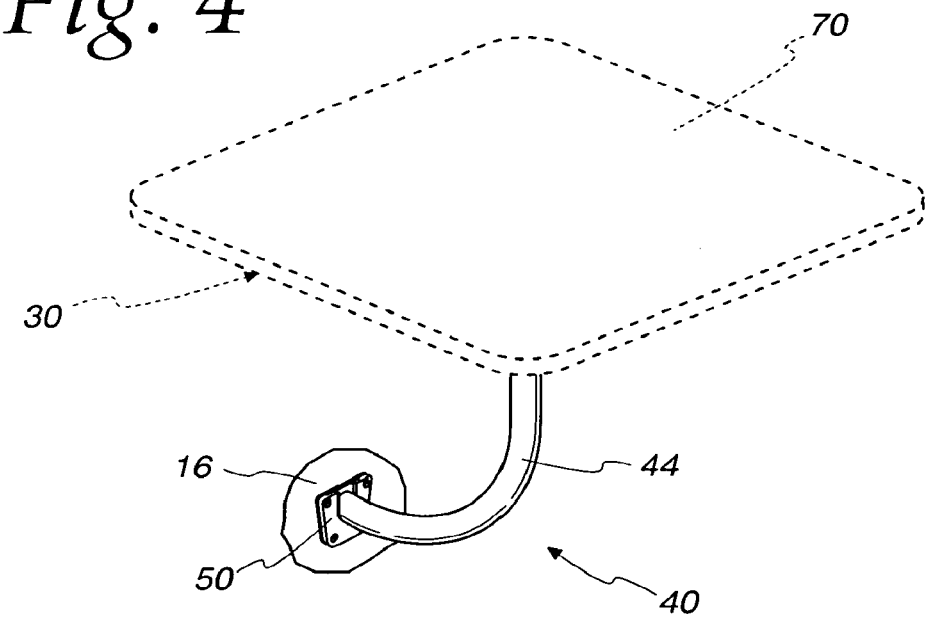
FIG. 4 is a perspective view of the table mount of the present invention as mounted showing a table top secured thereon in phantom.
Figure 5:
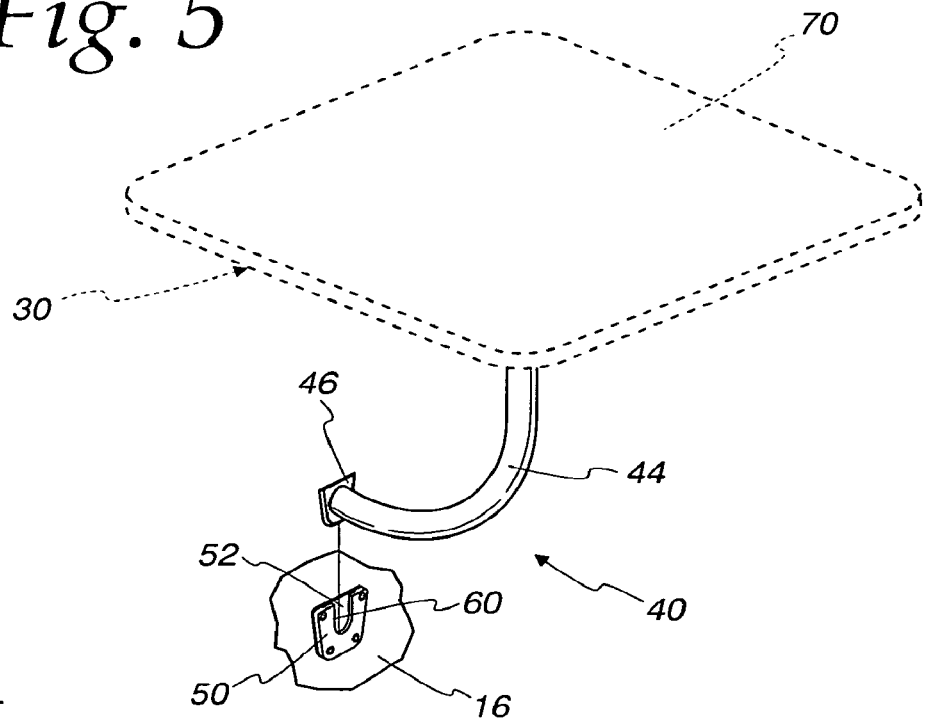
FIG. 5 is a perspective view similar to FIG. 4, showing the table prior to (and after) mounting according to the present invention.

In order to secure a device in a boat passenger area 12, the base plate 46 of the support arm 44 is lowered into the open top space between the plates 50, 52, whereby the mount 40 will be rigidly secured with its support arm 44 resting in the bottom of the slot 60 (see, e.g., FIGS. 2 and 4). Simple gravity and friction between the base plate 46 and the clamping and mounting plates 50, 52 will maintain the mount 40 in its desired configuration without being jarred out, even when the boat 10 is riding on rough waters. However, when it is desired to remove the device from the passenger area 12, it is a simple matter for a passenger to grasp the mount 40 and pull it back up out of the open top space between the clamping and backing plates 50, 52. In order to facilitate mounting and removal and minimize undesirable binding, the U-shaped open top slot 60 may advantageously have its sides tapered outwardly toward the open top.

The components of the mount 40 may be of any material having suitable strength to support the intended device and other objects which can be expected to be supported (e.g., food and drink on the table top 70). For example, the support arm 44 and clamping plate 50 may be of stainless steel, for strength, weather resistance, and appearance. Further, the backing plate 52 may be made of a hard plastic sufficient to stand up to the forces during mounting (as it is compressed between the base plate 46 and the boat side wall 16), while also providing some small amount of give and reduced friction to minimize binding of the base plate 46 when it is moved into and out of the open top space.

It should be appreciated that the above described invention will allow a variety of desirable devices to be removably mounted in the limited space of a boat passenger area 12, whenever such a device is desired by the passengers. Moreover, this mount 40 requires no structures in the deck 14 of the boat 10, and therefore does not create a safety risk for the passengers who may stumble over irregularities in the deck, nor does it require that undesirable holes be cut in the deck.

Still other aspects, objects, and advantages of the present invention can be obtained from a study of the specification, the drawings, and the appended claims. It should be understood, however, that the present invention could be used in alternate forms where less than all of the objects and advantages of the present invention and preferred embodiment as described above would be obtained.

The invention claimed is:

1. A recreational boat comprising:

a hull including a passenger user space with a deck and substantially vertical interior side walls extending up from the deck, said hull, deck and side walls preventing leakage of water into the passenger area and said side walls having a front face on the passenger user space side and an oppositely facing back face;

a substantially rectangular hard plastic backing plate having openings only at its corners;

a clamping plate having a U-shaped open top slot and corner openings aligned with said backing plate openings;

bolts extending through one interior side wall of said passenger user space and the corner openings of said backing plate and said cleaning plate and nuts secured to said bolts on the back face of the one side wall, whereby said backing and clamping plates are secured against the front face of said one substantially vertical interior side wall with an open top space defined between said clamping plate and said backing plate;

a table top; and a non-linear support arm having a base plate on one end and said table top on the other end, wherein said base plate is removably received in said defined open top space with said support arm one end extending through said open top slot of said clamping plate with said support arm extending substantially horizontally from said base plate and said support arm other end extending substantially vertically from the bottom of said table top;

whereby said table top and support arm may be removed from the side wall by lifting the support arm up relative to the side wall.

2. The boat of claim 1, wherein said open top space has a width tapering outwardly toward its open top.

3. The boat of claim 2, wherein said base plate is tapered with a shape substantially matching said open top space.

4. The boat of claim 1, wherein said support arm is a curved tube.

5. The boat of claim 1, wherein said clamping plate extends radially outwardly around said support arm at said support arm one end.

6. The boat of claim 1, wherein said clamping plate is metal.

* * * * *